US006295523B1

(12) United States Patent
Rosenkranz et al.

(10) Patent No.: US 6,295,523 B1
(45) Date of Patent: Sep. 25, 2001

(54) MAN-MACHINE INTERFACE

(75) Inventors: Daniel Rosenkranz, Uetendorf; Daniel Flueckiger, Muensingen, both of (CH)

(73) Assignee: Ascom Hasler Mailing Systems AG, Bern (CH)

( * ) Notice: Subject to any disclaimer, the term of this patent is extended or adjusted under 35 U.S.C. 154(b) by 0 days.

(21) Appl. No.: 09/152,959

(22) Filed: Sep. 14, 1998

Related U.S. Application Data

(60) Provisional application No. 60/059,099, filed on Sep. 16, 1997.

(51) Int. Cl.[7] ..... G07B 17/00

(52) U.S. Cl. ..... 705/410; 345/173; 705/401

(58) Field of Search ..... 345/173, 174, 345/175; 705/401, 408, 410

(56) References Cited

U.S. PATENT DOCUMENTS

| | | | | |
|---|---|---|---|---|
| 4,527,468 | * | 7/1985 | Piotroski | 101/2 |
| 4,527,790 | * | 7/1985 | Piotroski | 270/52.09 |
| 4,568,072 | * | 2/1986 | Piotroski | 270/58.23 |
| 4,811,240 | * | 3/1989 | Ballou et al. | 345/334 |
| 5,059,960 | | 10/1991 | Rosenberg et al. | 340/111 |
| 5,191,329 | * | 3/1993 | Samreus | 341/20 |
| 5,390,005 | * | 2/1995 | Kimoto et al. | 399/81 |
| 5,408,416 | * | 4/1995 | Gilham | 705/406 |
| 5,410,326 | * | 4/1995 | Goldstein | 348/734 |
| 5,437,010 | * | 7/1995 | Blackman et al. | 395/161 |
| 5,457,636 | * | 10/1995 | Sansone et al. | 700/235 |
| 5,510,992 | * | 4/1996 | Kara | 705/408 |
| 5,586,037 | * | 12/1996 | Gil et al. | 705/407 |
| 5,606,507 | * | 2/1997 | Kara | 705/408 |
| 5,656,799 | * | 8/1997 | Ramsden et al. | 177/2 |
| 5,682,318 | * | 10/1997 | Kara | 705/402 |
| 5,717,597 | * | 2/1998 | Kara | 705/408 |
| 5,737,504 | * | 4/1998 | Yamada | 358/1.18 |
| 5,737,729 | * | 4/1998 | Denman | 705/401 |
| 5,778,076 | * | 7/1998 | Kara et al. | 380/51 |
| 5,819,240 | * | 10/1998 | Kara | 705/408 |
| 5,831,220 | * | 11/1998 | Ramsden et al. | 177/1 |
| 5,884,292 | * | 3/1999 | Baker et al. | 705/403 |

FOREIGN PATENT DOCUMENTS

| | | | |
|---|---|---|---|
| 0 499 497 A2 | | 1/1992 | (EP) . |
| 0 604 148 A2 | | 6/1994 | (EP) . |
| 0 731 425 A1 | | 9/1996 | (EP) . |
| 0 762 338 A2 | | 3/1997 | (EP) . |
| 09088852 | * | 4/1999 | (EP) . |
| 2 721 730 | | 12/1995 | (FR) . |
| 3-208194 | * | 9/1991 | (JP) . |
| 04-338814 | * | 11/1992 | (JP) . |
| 08-221168 | | 8/1996 | (JP) . |

OTHER PUBLICATIONS

"Touch–Sensitive Screen Proximate and Electrically Composable Display"; IBM Technical Disclosure Bulletin; Jun. 1, 1984, vol. 27, n1A, pp. 43–44.*

* cited by examiner

*Primary Examiner*—Edward R. Cosimano
(74) *Attorney, Agent, or Firm*—James F. McLaughlin; Perman & Green, LLP

(57) ABSTRACT

A postage meter (franking machine) is provided having a limited number of physical (mechanical) keys associated with frequently performed tasks, and a touch-sensitive display of limited size with regions associated with rarely performed tasks. Optionally a receiving area is provided which can receive a printed sheet, and a touch-sensitive area is juxtaposed with the sheet, permitting user selection of items on the printed sheet. By means of a scrolled display of subsets of a character set, the user may readily create text strings on the touch-sensitive display of limited size. A history is kept of frequently selected print parameters, and the user can scroll through a list derived from the history.

6 Claims, 5 Drawing Sheets

MAN-MACHINE INTERFACE

This application claims priority from provisional application No. 60/059,099 filed Sep. 16, 1997, which is hereby incorporated by reference.

The invention relates to postage meters (franking machines) and relates more particularly to an improved man-machine interface relating thereto.

BACKGROUND OF THE INVENTION

It is desirable that a machine give the user the opportunity for solution of the user's problems as easily, intuitively, and fast as possible. In the particular area of postage meters (franking machines) the user may need to configure the meter generally, or may need to set up the meter for applying some postage value to a particular mail piece.

Historically, most postage meters have keyboards with dedicated keys. Dedicated keys are simple to use. But in the modern global marketplace it is desirable to be able to serve many markets (with differing languages and regulatory requirements) with minimal or no hardware changes.

One approach is to provide a large touch screen, typically with a graphics display. The large touch screen may make it unnecessary to provide a separate physical keyboard at all. But a large touch screen is expensive, and can be fragile. For some repeatedly executed keyboard functions it may be desirable to retain at least some physical keys separate from the screen, even if other functions are carried out on the touch screen.

Still another approach is to provide "soft keys", which are keys devoid of any physical labeling, juxtaposed with a large screen (typically a graphical liquid crystal display screen), a portion of which is dedicated to providing labels for the keys. In this way, a set of soft keys can have one set of meanings (and labels) in one context, and may have a different set of meanings (and labels) in another context. The result is to reduce the number of keys needed, and is also to provide some capability to modify the machine for use in different countries.

One such postage meter system is shown in U.S. Pat. No. 5,437,010 to Blackman et al.

But in the particular area of low-end (inexpensive) postage meters, none of these approaches is ideal. A large graphical display screen is expensive. In many man-machine interface designs, not enough attention is paid to the fact that some user tasks are repeated with the same parameters or user inputs.

SUMMARY OF THE INVENTION

A postage meter (franking machine) is provided having a limited number of physical (mechanical) keys associated with frequently performed tasks, and a touch-sensitive display of limited size with regions associated with rarely performed tasks. Optionally a receiving area is provided which can receive a printed sheet, and a touch-sensitive area is juxtaposed with the sheet, permitting user selection of items on the printed sheet. By means of a scrolled display of subsets of a character set, the user may readily create text strings on the touch-sensitive display of limited size. A history is kept of frequently selected print parameters, and the user can scroll through a list derived from the history.

DESCRIPTION OF THE DRAWING

The invention will be described with respect to a drawing in several figures, of which.

DETAILED DESCRIPTION

Figure 12:
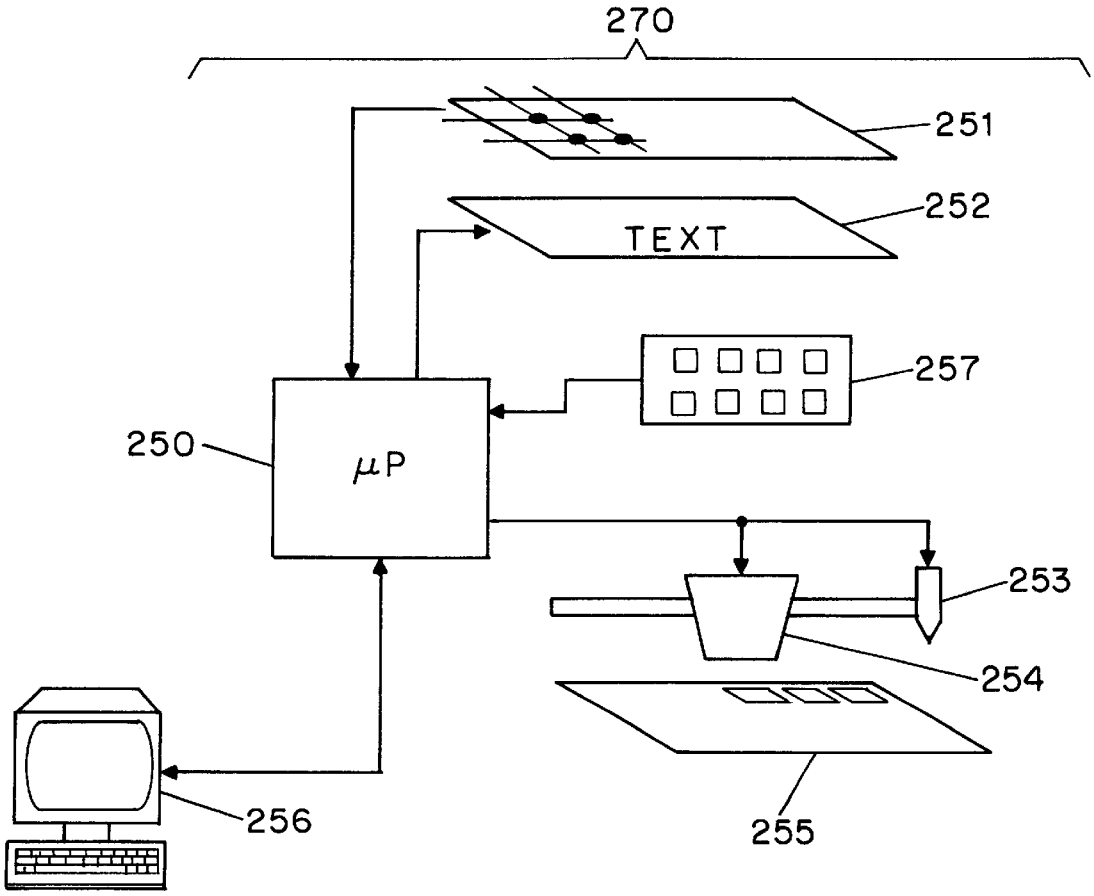
FIG. 12 shows in functional block diagram form a postage meter system in accordance with the invention.

Turning first to FIG. 12, there is shown a postage meter (franking machine) system in accordance with the invention. A processor 250 mediates most of the activities of the postage meter 270. Preferably the processor 250 includes a microprocessor and memory containing a stored program, as well as RAM and nonvolatile memory, all omitted for clarity in FIG. 12. The nonvolatile memory can be EEPROM.

A keyboard 257 with physical keys (typically keys which are spring-loaded and which move when pressed) is communicatively coupled with the processor 250, typically by means of electrical wiring. A display 252 is communicatively coupled with the the processor 250, typically by means of electrical wiring. The display may be a text display of as little as two lines of sixteen characters each, or for example it may be a graphical display. Typically the display is a liquid-crystal display. Superposed on the display 252 is a touch-sensitive pad 251, communicatively coupled with the processor 250, typically by electrical wiring. The pad 251 can be a pressure-sensitive pad using elastomers between row and column electrodes, thus measuring resistance or capacitance at the row and column intersections. Alternatively it can be a conductive pad that measures conductivity as the finger touches row and column intersections. Other well-known technologies for touch-sensitive pads may also be used.

A print means 253, 254 is controlled by the processor 250 and prints on mail pieces 255. Typically the print means is an ink-jet print head 254 which is transported by a head transport mechanism 253. The particular printing technology used and the physical arrangement of the print means can be any of a number of well-known technologies.

Optionally there can be a personal computer 256 communicatively coupled with the postage meter 270. The communicative coupling can be an asynchronous serial data line, or can be ethernet, or can be by means of infrared serial data communication, for example. The particular coupling may be any of a number of well-known technologies. Optionally the communications between the personal computer 256 and the postage meter 270 may be cryptographically secure.

Figure 2:
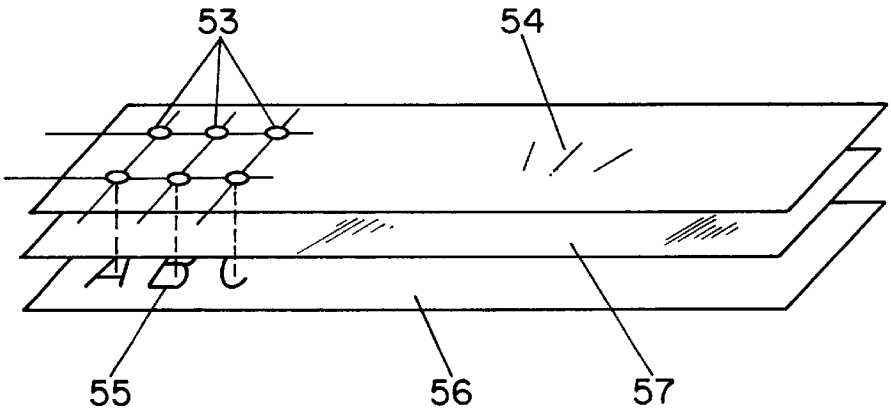
FIG. 2 shows in exploded view a text display with a touch-sensitive membrane.

Turning now to FIG. 2, there is shown in exploded view a text display 56 with a touch-sensitive membrane 54.

Preferably a protective glass plate 57 is between the display 56 and the membrane 54. Row-and-column intersections 53 are sensitive to touch, which with many technologies means that they are sensitive to pressure. Preferably the touch-sensitive intersections correspond on a one-to-one basis with the characters 55 that appear on the display 56.

Figure 3:
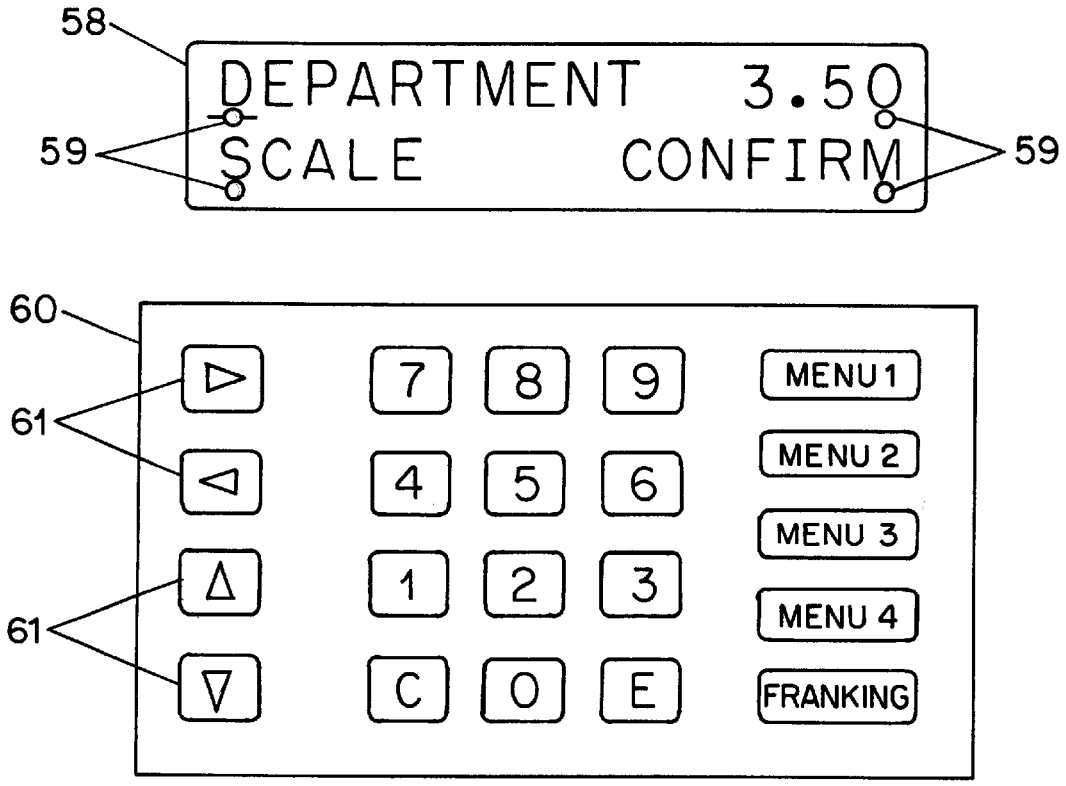
FIG. 3 shows in plan view a man-machine interface with a text display and a hardware keyboard, including hardware cursor keys and associated cursor points on the display.

Turning now to FIG. 3, there is shown in plan view a man-machine interface with a text display 58 and a hardware keyboard 60, including hardware cursor keys 61 and associated cursor points 59 on the display. This arrangement is not optimal because it calls for a large number of physical (mechanical) keys.

Figure 1:
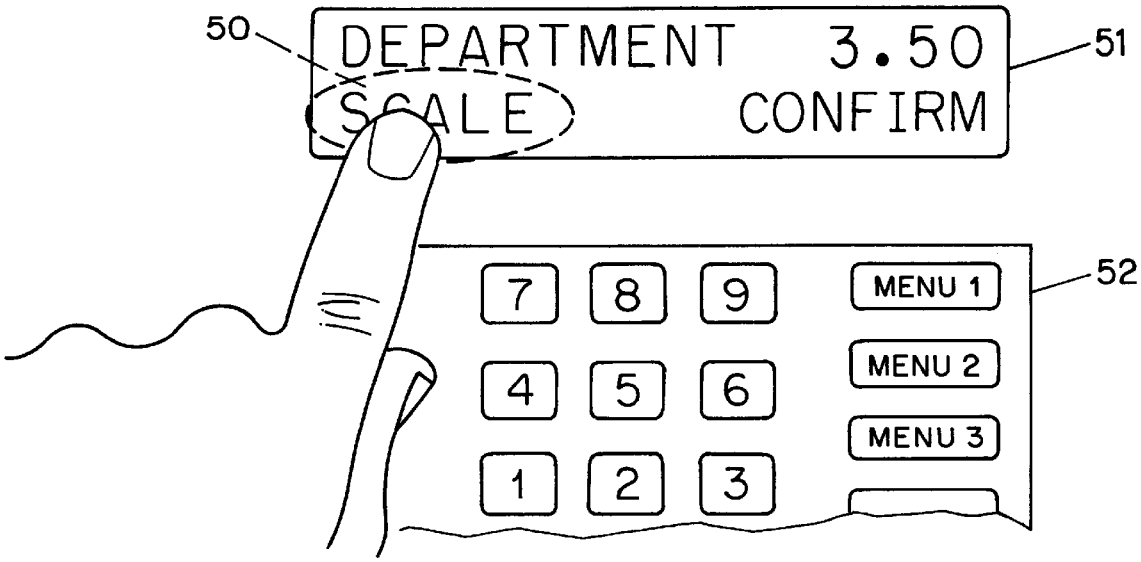
FIG. 1 shows in plan view a man-machine interface with a text display and a hardware keyboard.

Returning to FIG. 1, there is shown in plan view a man-machine interface with a text display 51 and a hardware keyboard 52. The display 51 has touch areas 50. In this way a minimum of hardware keys is used along with a cheap character display, along with a touch-sensitive film. Each character is sensitive to pressure and activates the corresponding term on the display. The benefit is a reduction of the required number of hardware keys, a reduction of the number of user steps to a particular result, and an intuitive user interface. The combination of hardware keys for the basic, most-used functions (which is quick), together with the touch screen for versatility of user inputs, is superior to a design that uses only a touch screen or a design that uses only hardware keys. The arrangement is quite flexible and permits modification and adaptation of the postage meter to languages, countries, and versions of software, all by mere software changes (with no costly hardware changes required).

Several visual cues may be employed by the software engineer to indicate which items on the display screen are touch-sensitive. Such an item can be blinking, or can be shown in reverse video, or can be framed in a box or rectangle.

It should be appreciated that the system designer will identify some tasks that are frequently performed and other tasks that are rarely performed. A frequently performed task is presumably performed many times in a typical day, for example once per mail piece. A rarely performed task might be performed less often than once a day. The frequently performed tasks will as a general rule be associated with the hardware (physical) keys. The rarely performed tasks will as a general rule be associated with the "soft" keys, that is, the touch-sensitive areas at the display.

It should also be appreciated that in today's global marketplace, a typical postage meter design is preferably hardware-identical or nearly identical across many countries, yet is likely to be deployed into any of a number of countries with a variety of different languages. It is preferable to set up the processor so that it displays on the display screen legends in a selected language depending on the country in which the meter is to be used.

Figure 4:
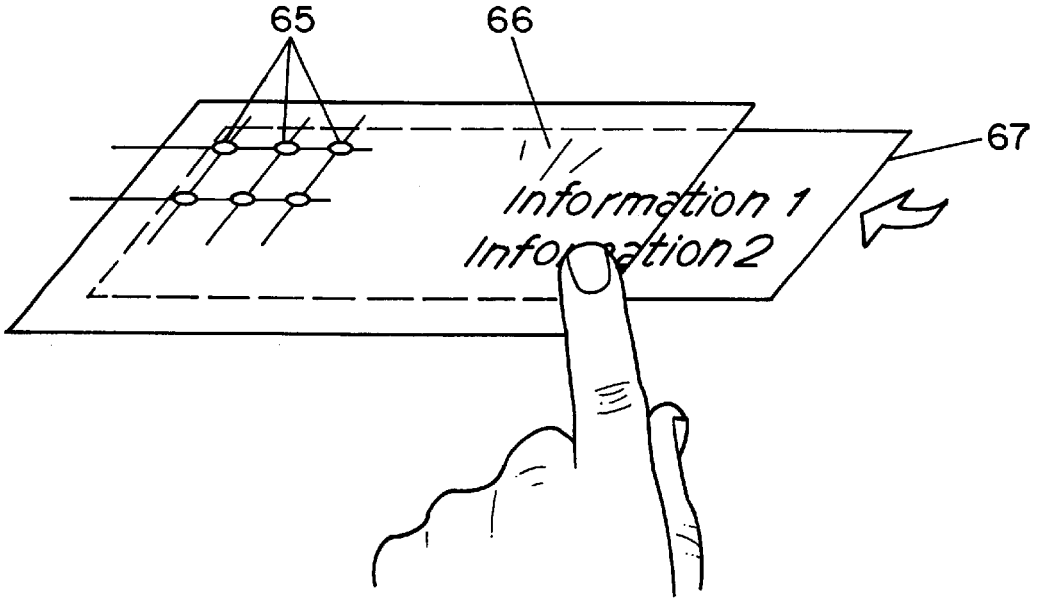
FIG. 4 shows in perspective view an apparatus including a printed slide-in sheet underneath a transparent touch-sensitive membrane.

FIG. 4 shows in perspective view an apparatus including a printed slide-in sheet 67 underneath a transparent touch-sensitive membrane 66. A touch-sensitive film is fixed on the postage meter in a way that permits a piece of paper to be inserted as into an envelope. The user can configure a particular solution (an image or text item, typically) and can then print it out. For example if the user is able to print any of several ads in the ad region 202 (FIG. 11) then the several ads can all be printed onto a paper sheet 67. This is inserted under the film 66. The user can then select the concerned feature (such as an ad or user-selected print field), by pressing the film.

The arrangement of FIG. 4 is quite versatile. It is cheap and yet very flexible. Graphics or text can be selected equally conveniently, and additional keys or user features can be added to the postage meter with this arrangement.

Described another way, the printing means of the postage meter is set up so that it can print postage indicia on mail pieces and can print items of information on a sheet. A receiving area is shaped to receive the sheet, and the receiving area has a substantially transparent touch-sensitive pad 66 overlaid thereupon, the pad 66 having a plurality of touch-sensitive areas 65 disposed across its area. The printing means prints items of information on the sheet 67 positioned such that when the sheet is inserted into the receiving area, then the items of information are juxtaposed with associated touch-sensitive areas 65.

Figure 5:
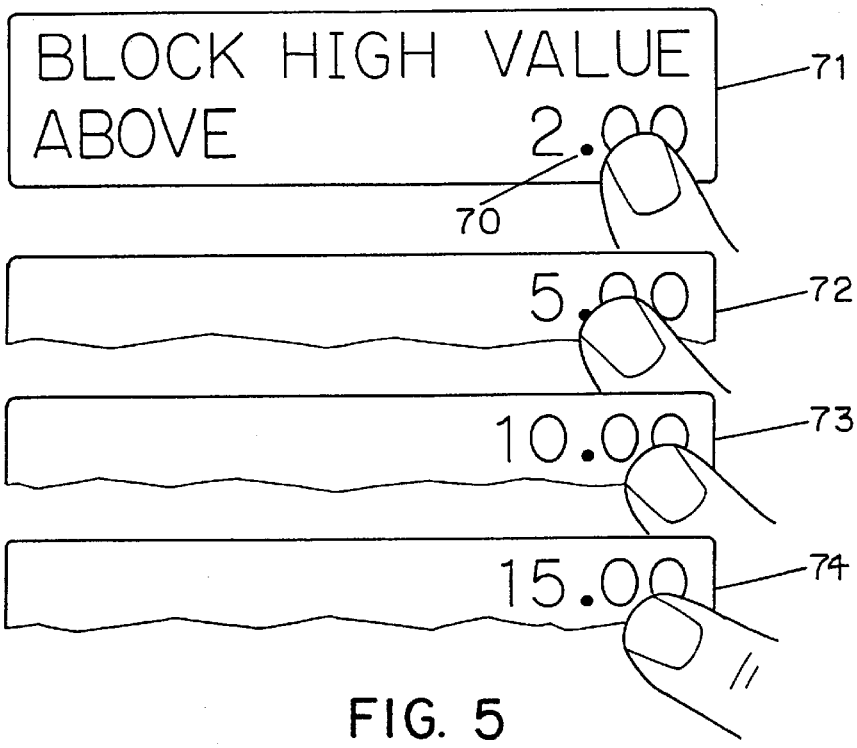
FIG. 5 shows in time sequence the steps to select a user parameter.

FIG. 5 shows in time sequence the steps to select a user parameter. For example, there may be a high-value (high postage value) limit which can be adjusted by the user. The starting value 70 (FIG. 5) is shown in screen 71. With repeated presses of the touch-sensitive pad the value is selected as shown at 72, 73, 74. This avoids data entry errors and minimizes the interruption of work procedures. Importantly, the user is not permitted to change the contents of the list of scrolled values. This technique may be applied to other parameters such as the low-funds warning.

A traditional problem with postage meters is that user-definable expressions, such as departments to which postage totals are charged, are typically limited to numerical values in a table, since the user input device is little more than a numeric keypad. It would be desirable to permit user input of generalized characters including letters, numbers, and other language-specific characters. This would permit user-definable expressions, such as departments, to be in clear text, including the language-specific characters.

Figure 6:
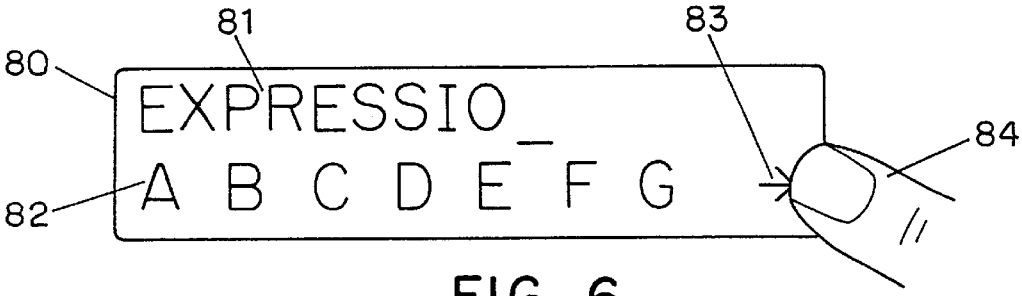
FIGS. 6, 7 and 8 show steps in the user selection of elements of a text string.

FIG. 6 shows a user mode in which a user-definable expression (text string) is being entered. The display 80 requires only two lines. An upper line 81 shows the written text, that is, the text string being entered. A lower line 82 permits the user to have access to all available characters. An arrow 83 shows where other characters than the visible ones are hidden. Touching an arrow 83 by means of a finger 84 moves the listed characters in the indicated direction. Touching a character 85 (FIG. 7) writes it into the display 86.

Figure 8:
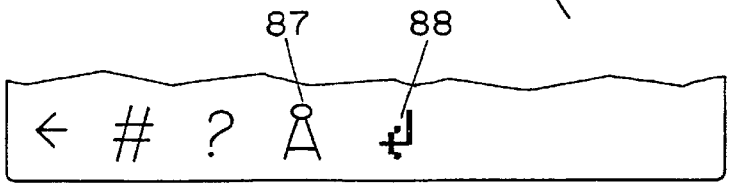

It will be appreciated that all of the characters in the machine can be written, including language-specific characters and specific symbols. It costs nothing to provide variants in the character set. A typical liquid crystal display will use a 5 by 7 matrix, and the software engineer can create a variety of language-specific characters such as characters 87, 88 in FIG. 8.

In many systems the numeric keys are used to enter letters and other characters, which requires that alphabet indications appear on the keys. With the user input arrangement just described, the numeric keys do not require alphabetic (letter) indications.

Figure 7:
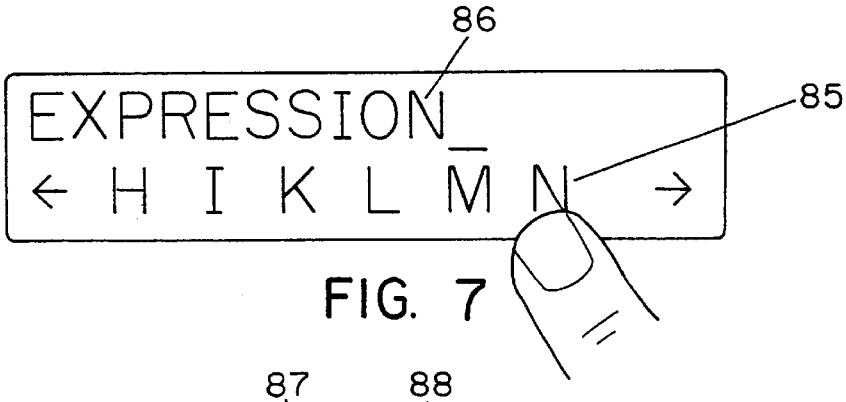

Another way to describe this is that the user interface comprises a display screen 80 with a substantially transparent touch-sensitive pad overlaid thereupon, said pad having a multiplicity of touch-sensitive areas disposed across its area, each said touch-sensitive area having a respective associated area of said display screen. The processor displays on a first portion 81 of the display screen a text string, and displays on a second portion of the display screen 82 a displayed one of a plurality of subsets of a character set together with a symbol 83 indicative of a change of the displayed one of the plurality of subsets. If the user touches one of the displayed elements 85 (FIG. 7), the selected displayed element is added to the text string at 86 (FIG. 7).

It will be appreciated that a user needs to know, at all times, whether the postage meter is ready to frank letters or tapes. This needs to be clear and unambiguous. Ideally a green light shows if the machine is ready to operate. The green light is preferably a high-brightness light-emitting diode, located at the upper left side of the display. An acoustic signal may augment the visual signal. This frees up space in the display that would otherwise be required to communicate a "ready" message.

An advantageous feature of a postage meter according to the invention is the provision of an alarm clock. Normally there is a daily routine associated with the postage meter, with a deadline associated with the last possible time for depositing mail at the post office or in a collection box. To assist the user in meeting this time, an alert function is built into the postage meter. In a specific submenu, the user can set the time of the alarm. If the alarm time has been set, then the postage meter produces an acoustic signal (such as a beep or series of beeps) which persists until cleared by the user or until a predetermined interval has passed. The interval is likewise user-settable.

Another advantageous feature is the numeric "short cut" for access to various submenus. The user can press a "short cut" key followed by several numeric digits. This takes the user to a position in a submenu. The user manual or other product literature can refer to the submenu positions by means of the numeric short cuts. Preferably the numerical short cut value is shown on the screen as well.

Figure 9:
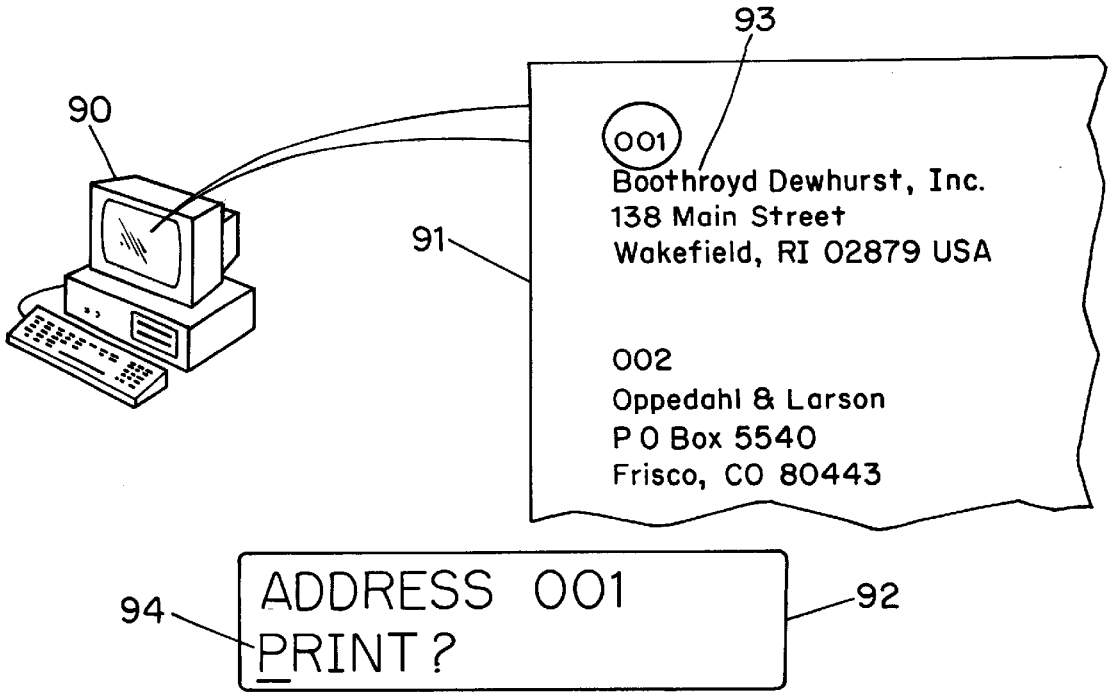
FIG. 9 shows steps in the user selection of an address to be printed on a mail piece along with a postage indicium.

FIG. 9 shows steps in the user selection of an address to be printed on a mail piece along with a postage indicium. Existing address data in a personal computer is desirably transferred to the postage meter and printed on a letter or other mail piece. A communications link or interface permits communications between the personal computer 90 and the postage meter. The result is that the postage meter becomes an addressing machine.

Of course, for this to work the print head needs to be able to reach an address field location. With many print means designs, this calls for a second print head or a removable print head. In one arrangement the addresses in the personal computer 90 are viewed on a screen 91 of the personal computer 90. If entry 93 is desired (with screen reference numeral "001", then at the postage meter display 92 a selection is made by pressing the "print" selection 94.

Another way to describe this is that within the personal computer are stored a plurality of address datums. The postage meter has a printing means for printing a postage indicium on a mail piece, and the printing means is further disposed to print an addressee field on the mail piece separate from the postage indicium. The user selects one of the address datums at said user interface, the address datum is received at the postage meter from the personal computer 90, and the printing means prints the postage indicium and the address datum on the mail piece. The user selection could optionally be done at the personal computer 90 instead.

Figure 10:
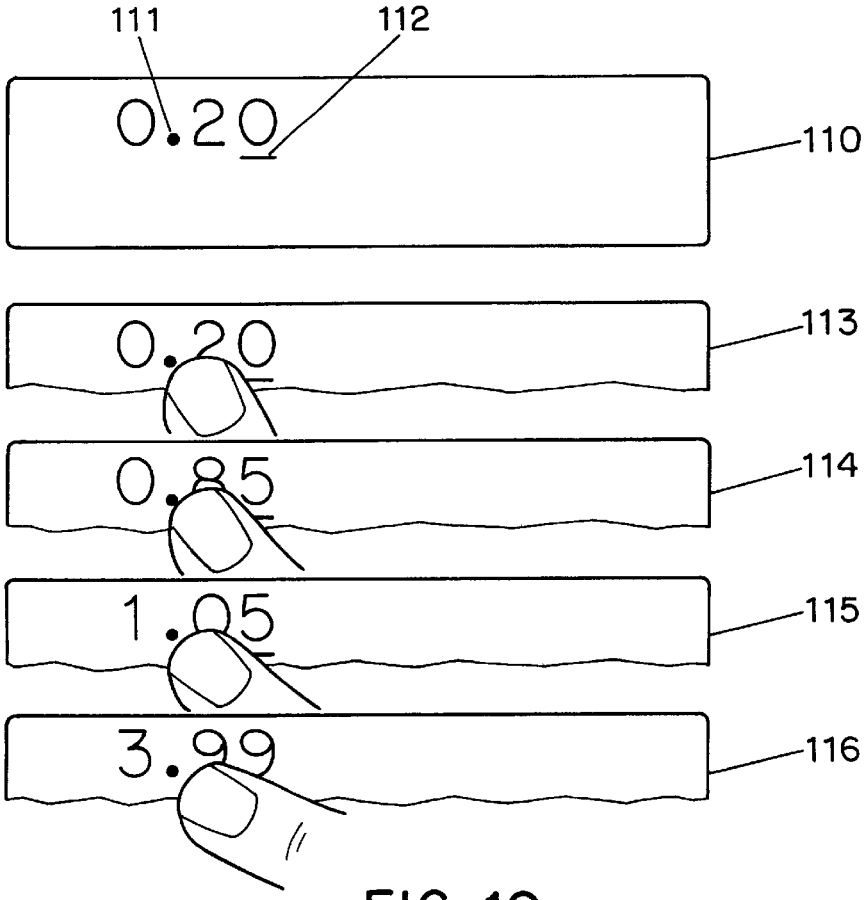
FIG. 10 shows in time sequence the steps to select a user parameter based on historical values of the parameter.

FIG. 10 shows in time sequence the steps to select a user parameter. The user is able to scroll through a preprogrammed list, a user-defined list, or a list based on historical values of the parameter of interest. The display 110 shows a parameter 111, and the user learns that it may be scrolled by means of a flashing cursor 112 or some other visual indication such as reverse video or a framed rectangle around the changeable parameter. Each touch of the parameter scrolls through a value 113, 114, 115, or 116. The elements selected in this way can be any frequently used elements, such as franked values (postage amounts), department names or numbers, and scale parameters. A chief benefit of this approach is the quick availability of the elements, and the avoidance of errors in the case of complicated entries.

In accordance with the invention, it is desirable that frequently used values should be selectable in a comfortable (quick and safe) way. Based on the most frequently entered values, the postage meter creates automatically a list of the most frequently used values. This can be superior to a preprogrammed list because the preprogrammed list may not be up to date. There is no need for changes to the list to be manually performed by the user nor for changes to be performed by a service engineer, because the list is updated automatically.

Typically during some predetermined time period (such as one week), or until a certain number of values (such as 200) has been reached, the meter captures all values and automatically creates a list of the most frequent values (perhaps five most frequent different values). Then, during franking mode, a list of such values can be scrolled based on actual daily needs.

Ideally there is provided a submenu to the user which permits viewing the contents of the list, but which does not permit the user to change the list contents directly.

Stated differently, the processor 250 (FIG. 12) is programmed to keep a history of values of particular user-selected parameters. The history is used to develop a list which can be sorted in order, typically numerical order. As the user touches a parameter value on the display, the value is changed to a second value and a third value in sequence.

Figure 11:
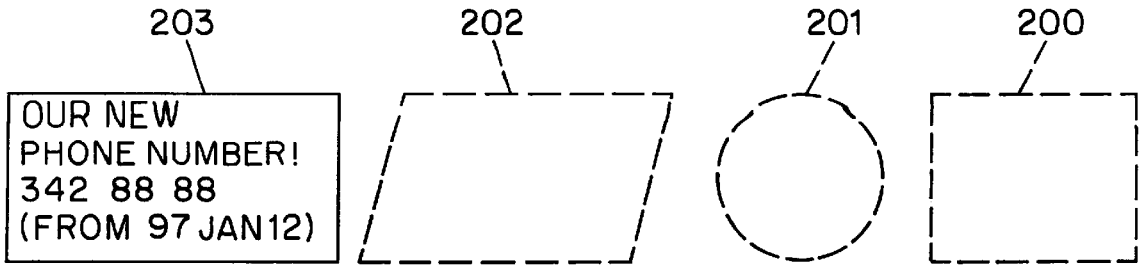
FIG. 11 shows an imprint on a mail piece including a postage indicium and a user-selected text field.

FIG. 11 shows an imprint on a mail piece including a postage indicium 201, 200 and a user-selected text field 203 along with an optional advertisement image 202. A user-defined text field is available, located outside of the postal area, taking into account any pertinent postal regulations. The user is able to enter user-defined text into the postage meter and the text is printed by the postage meter onto the mail piece. This provides a cost-free way of placing user-defined information such as a return address onto the mail piece. Typically the text field would be to the left of the ad field 202.

Another way to describe this is that the print means is set up for printing a postage indicium on a mail piece, and is further set up to print a print field 203 on the mail piece adjacent the postage indicium 201, 200. The print means prints on the mail piece a postage indicium 201, 200; and prints on the mail piece within the print field 203 a user-selected item of information unrelated to the content of the postal indicium 201, 200.

One way that a user could select a user-selected text or image for printing in the text field 203 is by means of the above-described printed sheet 67 (FIG. 4). In this way, the user would cause the postage meter to print items of information on a sheet 67 (FIG. 4), and would insert the sheet 67 into a receiving area under a touch-sensitive pad 66. The user would touch an area 65 on the pad 66 associated with one of said items of information. The result would be that when postage is printed (FIG. 11), then there would be printed on said mail piece within said print field 203 the image associated with the item of information associated with the touched area 65 on the pad 66. As will be appreciated, the printed image in field 203 could be a text image or a graphical image.

what is claimed is:

1. A postage meter comprising a user interface and a processor and a printing means for printing postage indicia on mail pieces and for printing items of information on a slide-in sheet, said processor communicatively coupled with said user interface and with said printing means; said user interface comprising:

a receiving area shaped to receive said slide-in sheet, said receiving area having a substantially transparent touch-sensitive pad under which the slide-in sheet is placed, said pad having a plurality of touch-sensitive areas disposed across its area; and means within said processor for causing said printing means to print said items of information on said slide-in sheet, wherein, after being printed, if the slide-in sheet is positioned in said receiving area, said items of information on said slide-in sheet are juxtaposed with associated touch-sensitive areas on the pad.

2. The meter of claim 1 wherein said touch-sensitive pad is pressure-sensitive.

3. A method for use with a postage meter comprising a user interface and a processor and a printing means for printing a postage indicium on a mail piece and for printing items of information on a slide-in sheet, each of said items of information associated with a respective image, said processor communicatively coupled with said user interface and with said printing means; said printing means further disposed to print a print field on said mail piece adjacent said postage indicium; said user interface comprising: a receiving area having a substantially transparent touch-sensitive pad, the receiving area shaped to receive said slide-in sheet, said slide-in sheet placed under said substantially transparent touch-sensitive pad, said pad having a plurality of touch-sensitive areas disposed across its area; and means within said processor for causing said printing means to print said items of information on said slide-in sheet positioned such that if said slide-in sheet is received by said receiving area, then said items of information are printed on said slide-in sheet juxtaposed with associated touch-sensitive areas; said method comprising the steps of:

causing said processor to cause said printing means to print items of information on a slide-in sheet;

inserting said slide-in sheet into said receiving area;

touching an area on the pad associated with one of said items of information; and printing on said mail piece within said print field the image associated with the item of information associated with the touched area on the pad.

4. The method of claim 3 wherein the printed image is a text image.

5. The method of claim 3 wherein the printed image is a graphical image.

6. A method for use with a postage meter comprising a user interface and a processor and a printing means for printing postage indicia on mail pieces and for printing items of information on a slide-in sheet, said processor communicatively coupled with said user interface and with said printing means; said user interface comprising: a receiving area shaped to receive said slide-in sheet, said receiving area having a substantially transparent touch-sensitive pad under which the slide-in sheet is placed, said pad having a plurality of touch-sensitive areas disposed across its area; and means within said processor for causing said printing means to print said items of information on said slide-in sheet wherein after being printed, if the slide-in sheet is positioned in said receiving area, then said items of information on said slide-in sheet are juxtaposed with associated touch-sensitive areas on the pad; said method comprising the steps of:

causing said processor to cause said printing means to print items of information on a slide-in sheet;

inserting said slide-in sheet into said receiving area; and touching an area on the pad associated with one of said items of information.

* * * * *